US008490369B2

(12) United States Patent
Foucher et al.

(10) Patent No.: US 8,490,369 B2
(45) Date of Patent: Jul. 23, 2013

(54) DISTRIBUTION SYSTEM AND METHOD

(75) Inventors: Pierre Foucher, Trois-Rivières (CA); Daniel Cassivi, Trois-Rivières (CA)

(73) Assignee: Planning Technologies International Inc., Quebec (CA)

( * ) Notice: Subject to any disclaimer, the term of this patent is extended or adjusted under 35 U.S.C. 154(b) by 76 days.

(21) Appl. No.: 12/597,426

(22) PCT Filed: Apr. 25, 2008

(86) PCT No.: PCT/CA2008/000799

§ 371 (c)(1), (2), (4) Date: Mar. 31, 2010

(87) PCT Pub. No.: WO2008/131548

PCT Pub. Date: Nov. 6, 2008

(65) Prior Publication Data

US 2010/0180547 A1 Jul. 22, 2010

Related U.S. Application Data

(60) Provisional application No. 61/024,307, filed on Jan. 29, 2008.

(30) Foreign Application Priority Data

Apr. 25, 2007 (CA) ..... 2585922

(51) Int. Cl.
*B65B 1/30* (2006.01)

(52) U.S. Cl.
USPC ..... 53/493; 53/284.7; 53/411; 53/469; 53/498

(58) Field of Classification Search
USPC ..... 53/133.4, 284.7, 411, 459, 469, 493, 53/494, 498, 504, 567, 576
See application file for complete search history.

(56) References Cited

U.S. PATENT DOCUMENTS 4,680,464 A * 7/1987 Bross ..... 250/223 R
5,618,252 A 4/1997 Melville (Continued)

FOREIGN PATENT DOCUMENTS

JP 2005-535525 A 11/2005
WO 2006060448 A2 6/2006

OTHER PUBLICATIONS

International Search Report, PCT/CA2008/000799, Aug. 29, 2008.

(Continued)

*Primary Examiner* — M. Alexandra Elve
*Assistant Examiner* — Eyamindae Jallow
(74) *Attorney, Agent, or Firm* — K&L Gates LLP

(57) ABSTRACT

A system for dispensing items comprises trays each adapted to support items to be dispensed. A casing comprises a restocking volume receiving trays with items thereon for subsequent storage. A storage volume accommodates the trays in storage. An outlet is used to dispense any selected items on the trays. An arm displaces trays within the casing, and displaces items from the trays to the outlet. A controller unit receives an identification of each item in the trays when positioned in the restocking volume, and monitors a position of each identified item within the trays in the casing to control the actuation of the arm to dispense items through the outlet as a function of an order entered through the user interface.

12 Claims, 13 Drawing Sheets

U.S. PATENT DOCUMENTS

| | | | | |
|---|---|---|---|---|
| 5,713,487 | A | 2/1998 | Coughlin | |
| 6,112,502 | A * | 9/2000 | Frederick et al. | |
| 6,175,779 | B1 * | 1/2001 | Barrett | 700/242 |
| 6,742,671 | B2 * | 6/2004 | Hebron et al. | 221/9 |
| 6,776,304 | B2 * | 8/2004 | Liff et al. | 221/2 |
| 6,883,681 | B1 * | 4/2005 | Coughlin et al. | 221/123 |
| 7,006,893 | B2 * | 2/2006 | Hart et al. | 700/235 |
| 7,059,098 | B2 * | 6/2006 | Kim | 53/131.4 |
| 7,123,989 | B2 * | 10/2006 | Pinney et al. | 700/237 |
| 7,139,639 | B2 * | 11/2006 | Broussard et al. | 700/225 |
| 7,182,105 | B1 | 2/2007 | Feehan et al. | |
| 7,787,986 | B2 * | 8/2010 | Pinney et al. | 700/232 |
| 2002/0103573 | A1 | 8/2002 | Fellows et al. | |
| 2003/0066264 | A1 * | 4/2003 | Kim | 53/285 |
| 2003/0145560 | A1 | 8/2003 | Melville | |
| 2005/0021173 | A1 | 1/2005 | Pinney | |
| 2006/0136095 | A1 | 6/2006 | Rob et al. | |
| 2006/0161293 | A1 | 7/2006 | William et al. | |

OTHER PUBLICATIONS

Extended European Search Report of European Publication No. 2149111, dated Feb. 6, 2012.

* cited by examiner

DISTRIBUTION SYSTEM AND METHOD

CROSS-REFERENCE TO RELATED APPLICATIONS

The present application claims priority on Canadian Patent Application No. 2,585,922, filed on Apr. 25, 2007, and on U.S. Provisional Patent Application No. 61/024,307, filed on Jan. 29, 2008.

FIELD OF THE APPLICATION

The present application relates to a dispensing system to distribute given items, and to manage the distribution of the given items, for instance in pouches or bags. The present application pertains to dispensing system used, among numerous applications, in dispensing medication and medical devices and products.

BACKGROUND OF THE ART

The management of inventory is a complex task, in that many factors are to be considered to minimize the inventory and ensure that products are always available to meet a demand. It is commonly known to have a person manage the distribution and restocking to keep control of the inventory.

In the medical or pharmaceutical field, the management of inventory is even more complex considering the additional factors of prescription, posology, expiration date and authorizations, due to the value of medication and pharmaceutical products. Accordingly, the inventory is often managed by personnel, representing an expensive solution.

SUMMARY OF THE APPLICATION

It is an aim of the present application to provide a novel distribution pouch and bagging apparatus to form the distribution pouch.

Therefore, in accordance with a first embodiment of the present application, there is provided a system for dispensing items comprising: trays each adapted to support at least one item to be dispensed; a casing comprising a restocking volume receiving trays with items thereon for subsequent storage, a storage volume for accommodating the trays in storage, an outlet for dispensing any selected one of the items on the trays, and an arm to displace trays at least between the to restocking volume and the storage volume, and for displacing items from the trays to the outlet; at least one user interface; and a controller unit for receiving an identification of each item in the trays when positioned in the restocking volume, and for monitoring a position of each identified item within the trays in the casing to control the actuation of the arm to dispense items through the outlet as a function of an order entered through the user interface.

Further in accordance with the first embodiment, the trays each have a pair of connectors on opposite edges so as to be manipulated by a grasping tool of the arm.

Still further in accordance with the first embodiment, the arm displaces the grasping tool along three translational degrees of freedom.

Still further in accordance with the first embodiment, the restocking volume and the storage volume each have shelves facing each other in the casing, and further comprising a transition table in the casing to allow the arm to put down a tray for the grasping tool to switch from one said connector to another said connector on a displaced tray to move said displaced tray between the shelves of the restocking volume to the shelves of the storage volume.

Still further in accordance with the first embodiment, the restocking volume and the storage volume each have shelves facing each other in the casing, with the restocking volume being accessed through an front panel of the casing for an operator to restock the casing.

Still further in accordance with the first embodiment, the system further comprises a front panel pivotable to provide access to an interior of the casing, with at least one of the user interface being on the front panel.

Still further in accordance with the first embodiment, the system further comprises a lockable protective wall between the front panel and the interior of the casing to further restrict access to an interior of the casing.

Still further in accordance with the first embodiment, the system further comprises a bagging apparatus at the outlet in the casing, so as to bag items being dispensed through the outlet.

Still further in accordance with the first embodiment, the bagging apparatus has a printer for printing on bags information related to the order of the item being dispensed.

Still further in accordance with the first embodiment, the bagging apparatus further comprises sealing and cutting apparatuses, to enclose dispensed items in closed pouches.

Still further in accordance with the first embodiment, the bagging apparatus comprises a support at the outlet, the support being displaceable vertically in order to support an item being bagged prior to the disposal.

Still further in accordance with the first embodiment, the system further comprises a selectively lockable door at the outlet so as to control access to the outlet.

Still further in accordance with the first embodiment, optical sensors confirm to the controller unit the dispensing of items for the controller unit to adjust inventory data.

Still further in accordance with the first embodiment, the user interface includes at least one of a touch-screen monitor, a bar-code reader, a keyboard.

Still further in accordance with the first embodiment, the system further comprises a disposal bin, the disposal bin having a drop opening selectively opened through the controller unit to return items in the system.

Still further in accordance with the first embodiment, the system further comprises a bulk dispenser in any one of the trays, the bulk dispenser being actuatable to output at least one item from a bulk container of items.

Still further in accordance with the first embodiment, the system further comprises a reader in the casing and readable data on the trays, for the controller unit to confirm an identity of each tray displaced in the casing.

In accordance with a second embodiment of the present application, there is provided a method for bagging items, comprising: identifying an item to be bagged; dispensing a variable length of tube as a function of the item to be bagged; positioning the tube with a top open end and a bottom closed in a chute; positioning a support under the tube as a function of the variable length of tube; and disposing the item into the tube.

Further in accordance with the second embodiment, the method further comprises sealing the top open end of the tube to conceal the item in the tube.

Still further in accordance with the second embodiment, the method further comprises confirming that the item is in the tube prior to sealing the tube.

Still further in accordance with the second embodiment, confirming that the item is in the tube comprises optically detecting said disposing the item into the tube.

Still further in accordance with the second embodiment, the method further comprises printing information on the tube, said information being associated with the item to be bagged.

DESCRIPTION OF PREFERRED EMBODIMENTS

Figure 10:
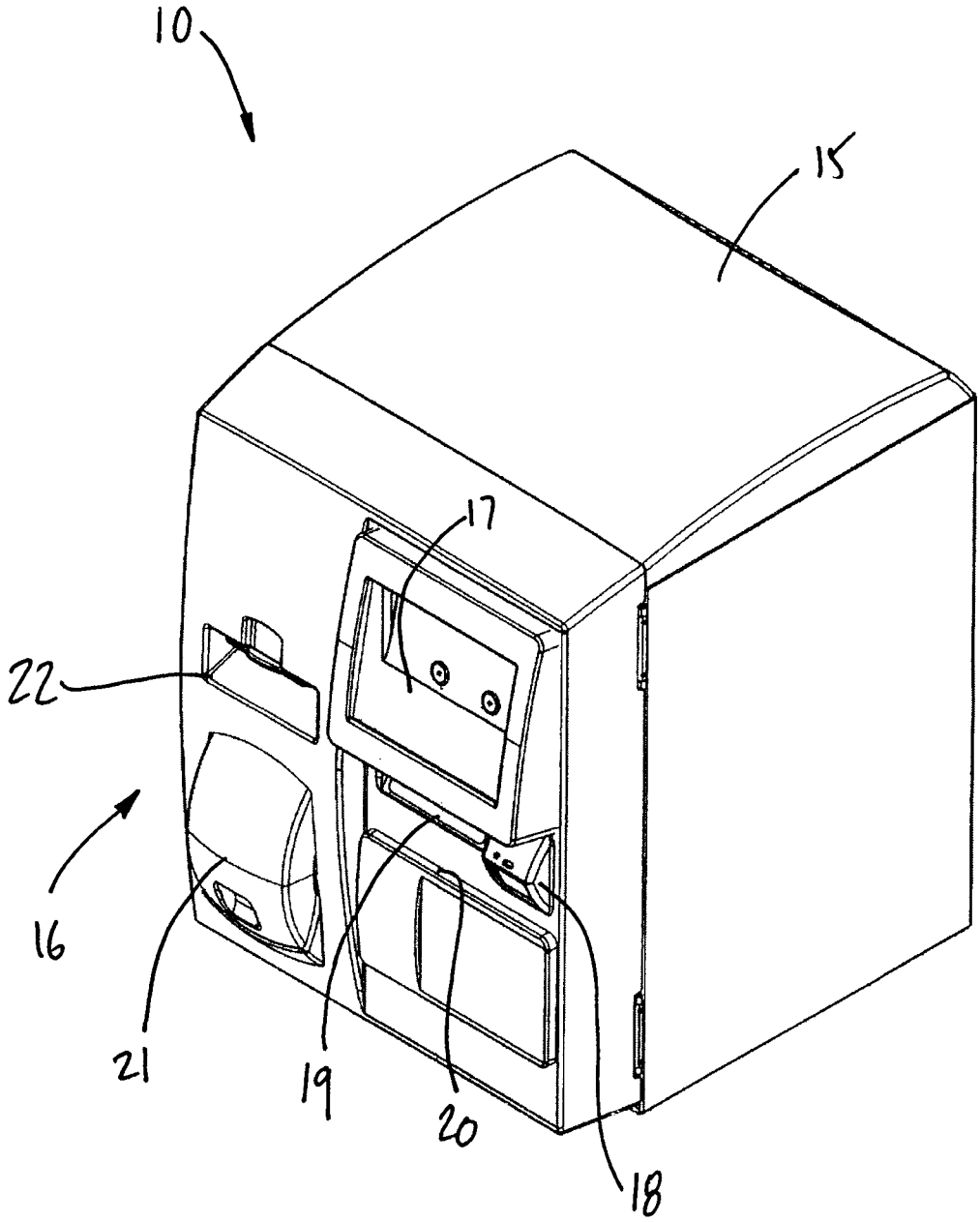
FIG. 10 is a perspective view of a dispensing system in accordance with an embodiment of the present application.

Referring to the drawings, and more particularly to FIG. 10, a dispensing system in accordance with an embodiment of the present application is generally shown at 10. The dispensing system 10 is used to dispense various items while controlling the inventory in view of factors such as inventory level and authorizations. In an embodiment, the dispensing system is used to dispense medication and medical products/devices. For simplicity purposes, the following description will refer to the dispensing of medication and medical products/devices, although the dispensing system 10 could be used in a plurality of other industries to stock and control the inventory of small parts/pieces.

The dispensing system 10 has a casing 15 with a front panel 16 hinged thereto. The casing 15 is made of a sturdy material so as to protect the contents of the dispensing system 10. The front panel 16 encloses the controller unit of the dispensing system 10, and supports the user interface components of a user interface system, by which a user interacts with the dispensing system 10 so as to perform various transactions related to the dispensing of products.

Figure 1:
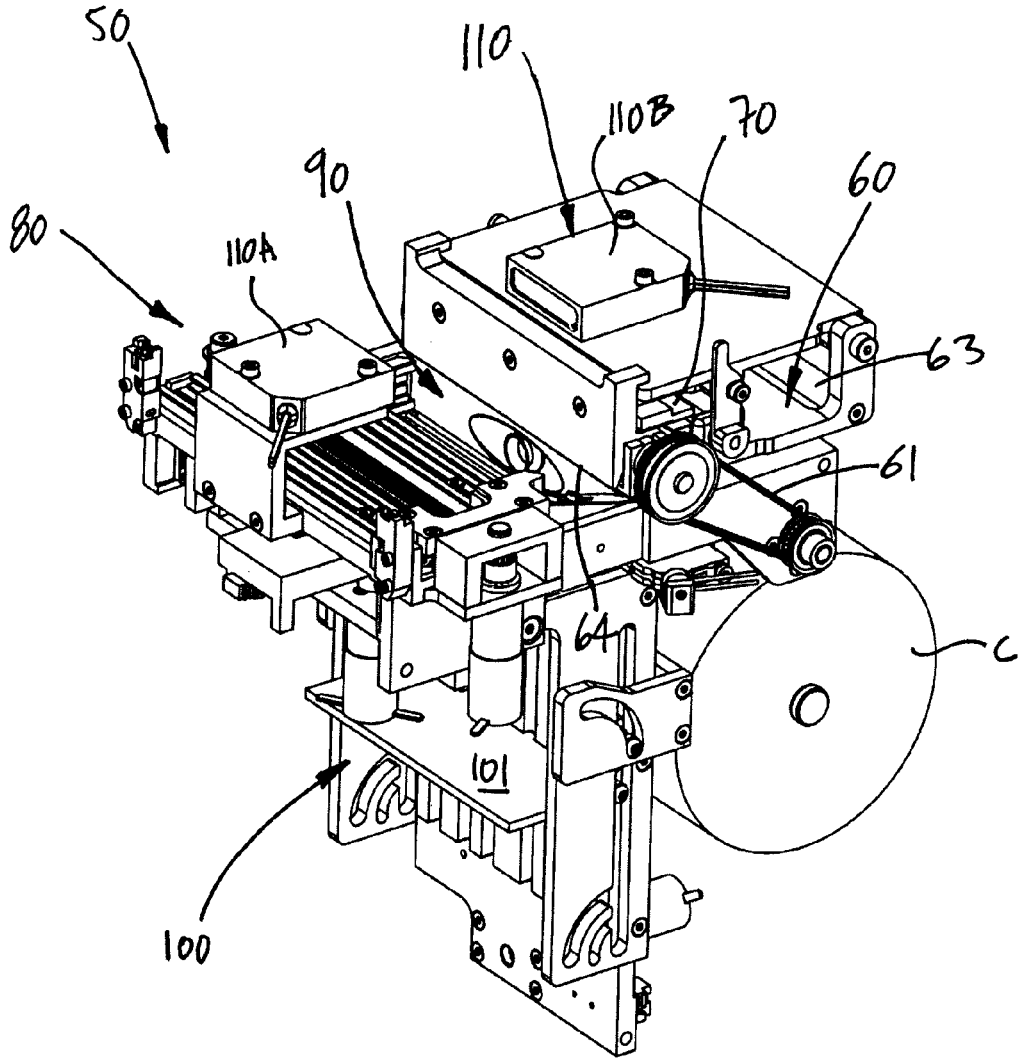
FIG. 1 is a front left-side perspective view of a bagging apparatus in accordance with an embodiment of the present application.

The front panel 16 of FIG. 1 features a monitor 17 by which information is displayed to command the dispensing system 10. In a preferred embodiment, the monitor 17 is a touch screen, by which the user of the dispensing system 10 can enter information, such as user identification, patient information, authorization codes, product identification for orders and returns, etc. Other alternatives are considered as well, for instance, using a keyboard or other interface tool.

A bar-code reader 18 is also provided in the front panel 16. The bar-code reader 18 may be used in order to authorize a transaction by the scan of an identification card. Moreover, the dispensing system 10 preferably offers the function of recuperating waste, such as used syringes, unused medication, etc. As will be described hereinafter, such products are typically packaged in a pouch having a bar code associated with the product. Accordingly, the bar-code reader 18 is used to record the identification of the product thrown to waste. Alternatives include RFID and other types of sensing technology.

As the dispensing system 10 will accept some waste, a drop opening 19 is provided in the front panel 16. The drop opening 19 typically features a trap or door that is opened once authorization has been granted by the dispensing system 10. The drop opening 19 communicates with a wastebasket or disposal bin within the front panel 16. In order to empty the wastebasket of the dispensing system 10, an access door 20 is provided in the front panel 16. The access door 20 can only be accessed by authorized personnel, whereby a lock is typically provided in the access door 20. Other identification may be required, for instance biometric recognition and the like.

Still referring to FIG. 1, an outlet 21 is provided in the front panel 16 so as to dispense the various products from the dispensing system 10. In an embodiment, the outlet 21 is related to a bagging apparatus within the dispensing system 10. The outlet 21 is preferably lockable, so as to ensure that it will only be opened at the time of a transaction with the dispensing system 10.

A sealing apparatus 22 is provided in the front panel 16. Considering that various items will be returned to the dispensing system 10 in a bag or pouch, the bag/pouch needs to be sealed to protect the contents to be returned. Accordingly, the sealing device 22 is self-service.

Other features may also be provided in the front panel 16. For instance, a fingerprint identifier may be provided for the quick authorization of transactions with the dispensing system 10.

It is observed that the front panel 16 in FIG. 10 has a nonnegligible thickness. The front panel 16 has an inner volume incorporating the controller unit for the interface components of the front panel 16. The controller unit is a processor that controls all movements within the casing and that accounts inventory data. The controller unit is connected to the user interfaces of the system 10, and drives all actuated mechanisms within the casing 15.

It is desired to provide a protective wall between the front panel 16 and an interior of the casing 15, so as to provide a second level of security to prevent unauthorized access to an interior of the casing 15.

Figure 11:
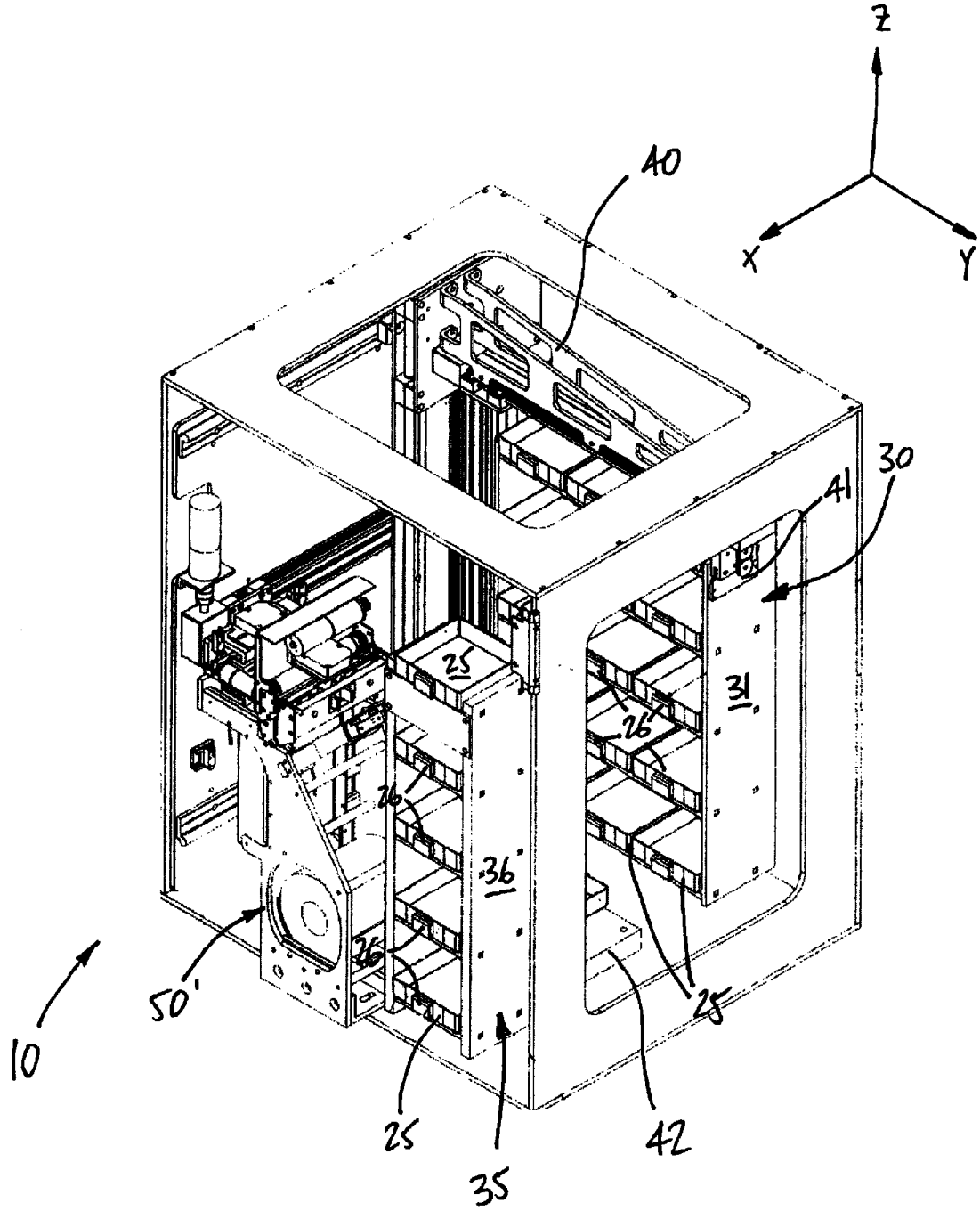
FIG. 11 is a perspective view of the dispensing system of FIG. 10, with an outer shell and front panel removed to show an interior thereof.
Figure 12:
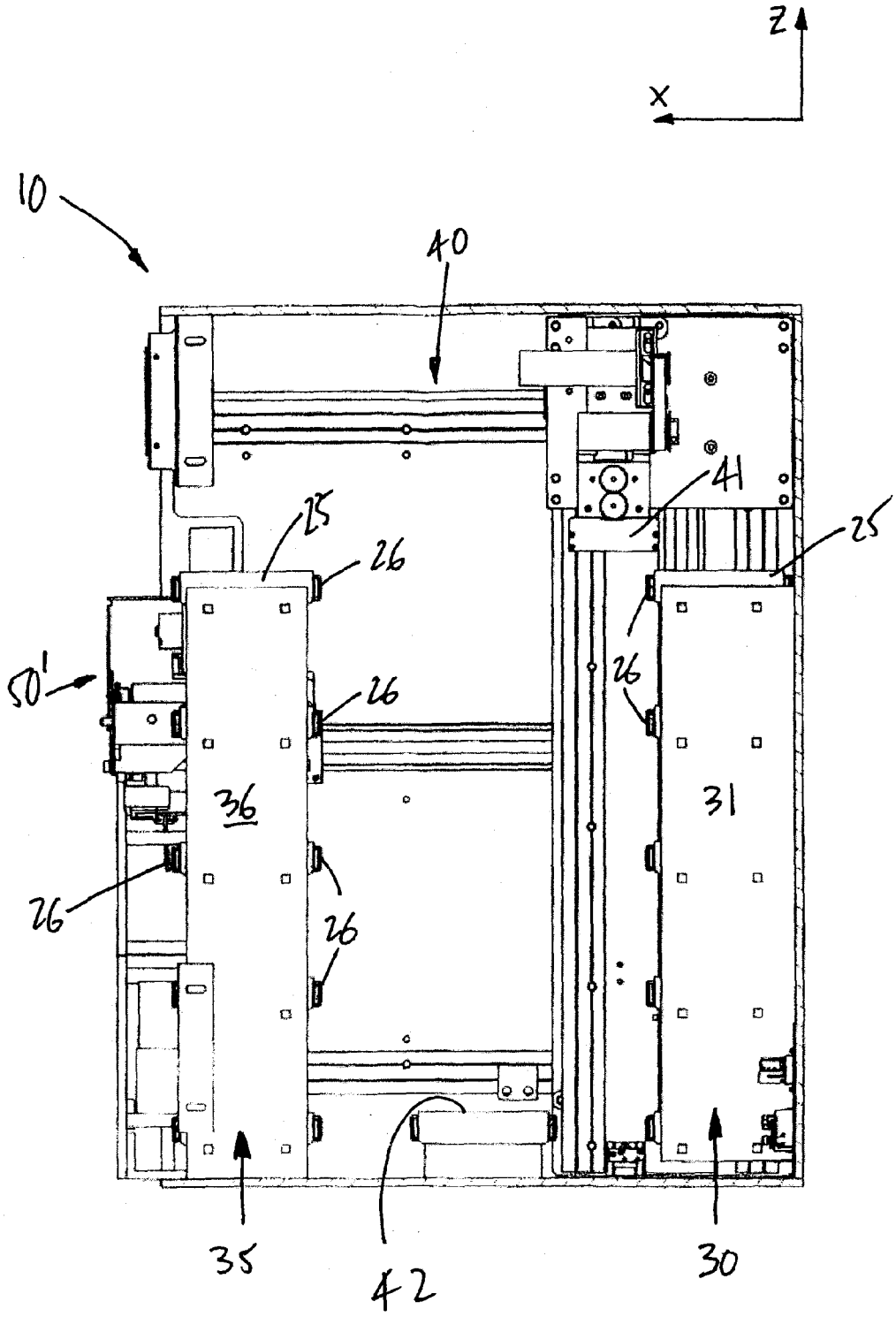
FIG. 12 is a side elevation view of the dispensing system of FIG. 10.

Referring concurrently to FIGS. 11 and 12, an interior of the casing 15 is shown. The various products stored in the dispensing system 10 are carried in trays or cassettes 25. Other similar devices can be used as alternatives to the trays/cassettes 25. The cassette 25 is concave so as to support items, and has front and rear connectors or hooks 26 (FIG. 2 for the rear hooks) so as to be manipulated within the casing 15.

A storage volume 30 is provided at a rear end of the casing 15, for the storage of the inventory. In the illustrated embodiment, the storage volume 30 consists of a plurality of shelves 31. The shelves 31 are shown supporting 15 different cassettes 25 although more or less positions could be provided as well, with each cassette position being known by the dispensing system 10.

A restocking volume 35 is provided at a front end of the casing 15. The restocking volume 35 features shelves 36, in which restocked cassettes or empty cassettes are positioned in view of the restocking of the dispensing system 10. In the illustrated embodiment, five different positions are provided for the cassettes 25, although more or less positions could be provided as well.

A robotic arm 40 displaces the cassettes 25 between the storage volume 30, the restocking volume 35 and a bagging apparatus, described hereinafter. In the embodiment of FIGS. 11 and 12, the robotic arm 40 is made of linear actuators, allowing cassettes to be displaced along three translational degrees of freedom, namely X, Y and Z. A grasping tool 41 is provided at an end of the robotic arm 40 and is actuatable to grasp the hooks 26 on the cassettes 25 so as to displace within the dispensing system 10. The robotic arm 40 and the grasping tool 41 are driven by the controller unit of the dispensing system 10.

In the illustrated embodiment, the grasping tool 41 accesses cassettes 25 in the shelves 31 of the storage volume 30 by grasping the front-end hook 26. On the other hand, in order to manipulate the cassettes 25 in the shelves 36 of the restocking volume 35, the grasping tool 41 grasps the rear-end hooks 26 of the cassettes 25. Accordingly, a transition table 42 is provided to enable the grasping tool 41 to temporarily put down a cassette to switch from read-end hook 26 to front-end hook 26, for displacing a cassette 25 from the restocking volume 35 to the storage volume 30. Accordingly, the presence of the transition table 42 optimizes the use of the space within the casing 15. It is observed that the presence of the transition table 42 allows the arm 40 to operate without any rotational joint, although rotational joints could also be used to provide a rotational degree of freedom to the grasping tool 41.

Referring concurrently to FIGS. 1 to 7, the bagging apparatus 50 for producing pouches is generally shown in greater detail, and is similar to the bagging apparatus 50' of FIG. 11. The bagging apparatus 50 supports a roll of tube and paper strip, as generally illustrated by C. The bagging apparatus 50 and all its components are driven by the controller unit of the dispensing system 10.

The bagging apparatus 50 features a feeding system 60 to feed the tube to a filling area, and a printer 70 to print data on the pouches. A cutting apparatus 80 is provided to cut and seal the pouches to an appropriate size. A sealing apparatus 90 seals the pouch with its contents. Chute support 100 is provided to support the weight of the contents of the pouches, prior to the pouch being cut and sealed off. An optical detector system 110 is provided to confirm whether items have been deposited into the pouch.

Figure 2:
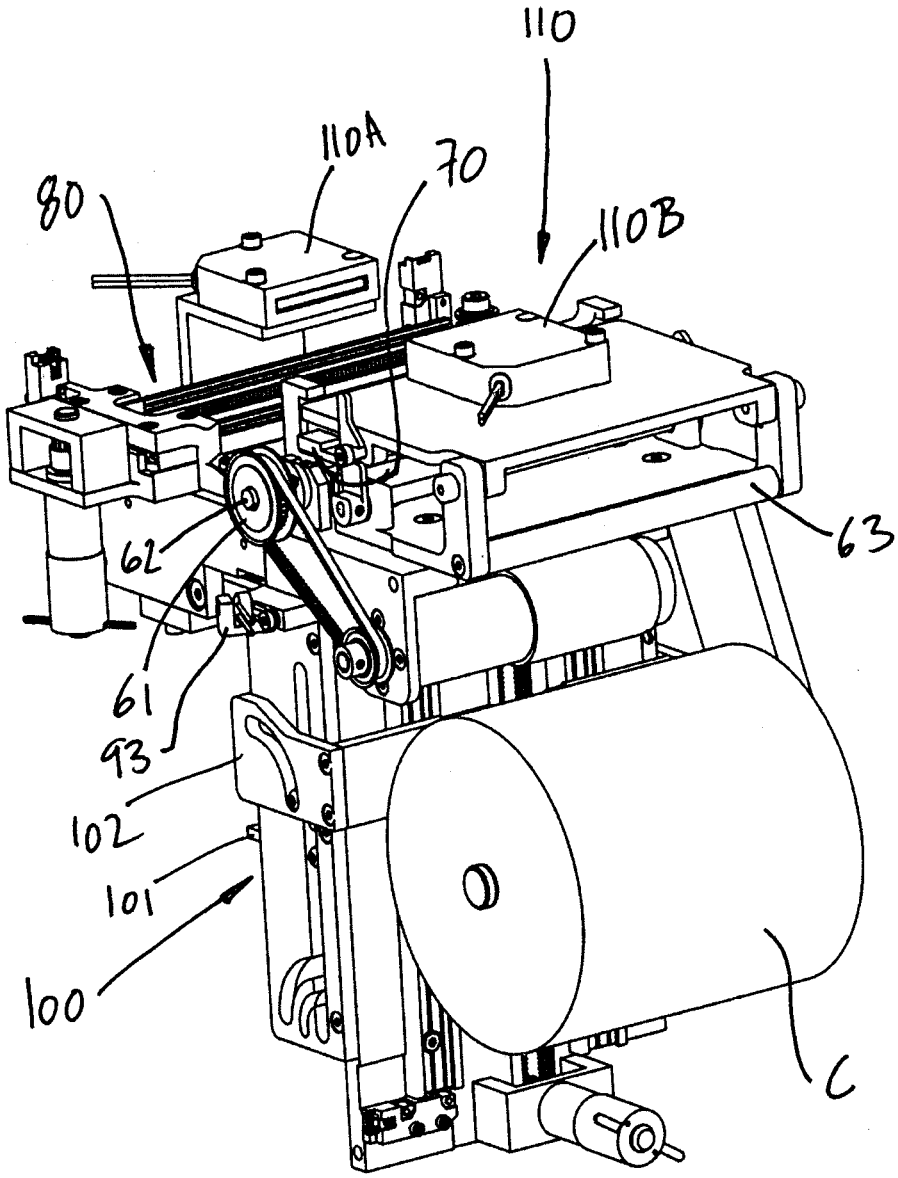
FIG. 2 is a front right-side perspective view of the bagging apparatus of FIG. 1.
Figure 4:
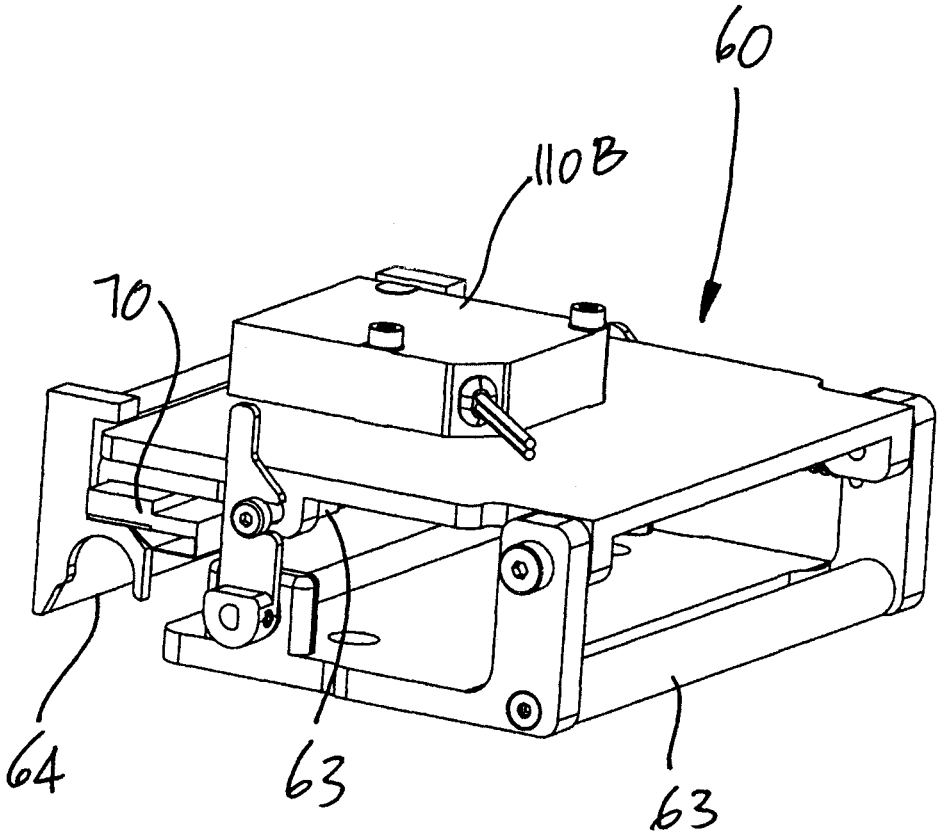
FIG. 4 is a perspective view of a printer of the bagging apparatus of FIG. 1.

Referring to FIGS. 1, 2 and 4, the feeding system 60 has a belt drive 61 by which a roller 62 is driven to dispense a length of tube from the roll C to the filling area of the bagging apparatus 50. Idler rollers 63 are used in combination with the driven roller 62 to provide suitable tension in the tube for its selective feed to the filling area. The tube is fed via the outlet 64, into the filling area of the bagging apparatus 50.

The printer 70 is adjacent to the driven roller 62 and is actuated to print information on the paper strip of the tube, in accordance with the contents of the pouch being formed. The printer 70 is selected as a function of the type of paper being used as paper strip.

Figure 5:
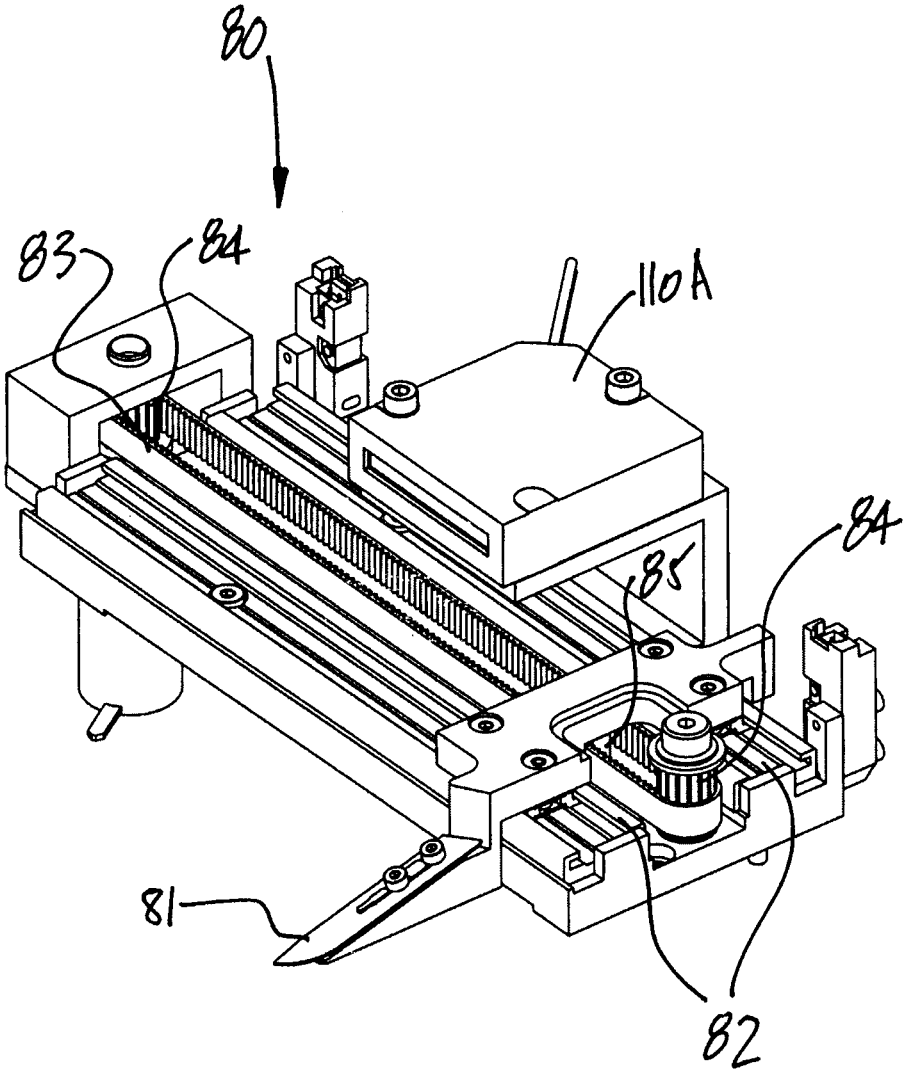
FIG. 5 is a perspective view of a cutting apparatus of the bagging apparatus of FIG. 1.

Referring to FIG. 5, the cutting apparatus 80 is positioned at a top end of the filling area of the bagging apparatus 50, and cuts the tube from the roll C to define a selected length of pouch. Moreover, the cutting apparatus 80 holds the open-ended pouch during the dispensing of items in the pouch, and seals the pouch with its contents.

The cutting apparatus 80 has a cutting tool 81 that is mounted to rails 82 so as to translate in the direction indicated by X in FIG. 5. The translation is controlled by way of a timing belt 83 that is actuated by gears 84. The cutting tool 81 comprises a rack 85 that is operatively connected to the timing belt 83 for the transmission of motion from the timing belt 83 to the cutting tool 81.

Figure 7:
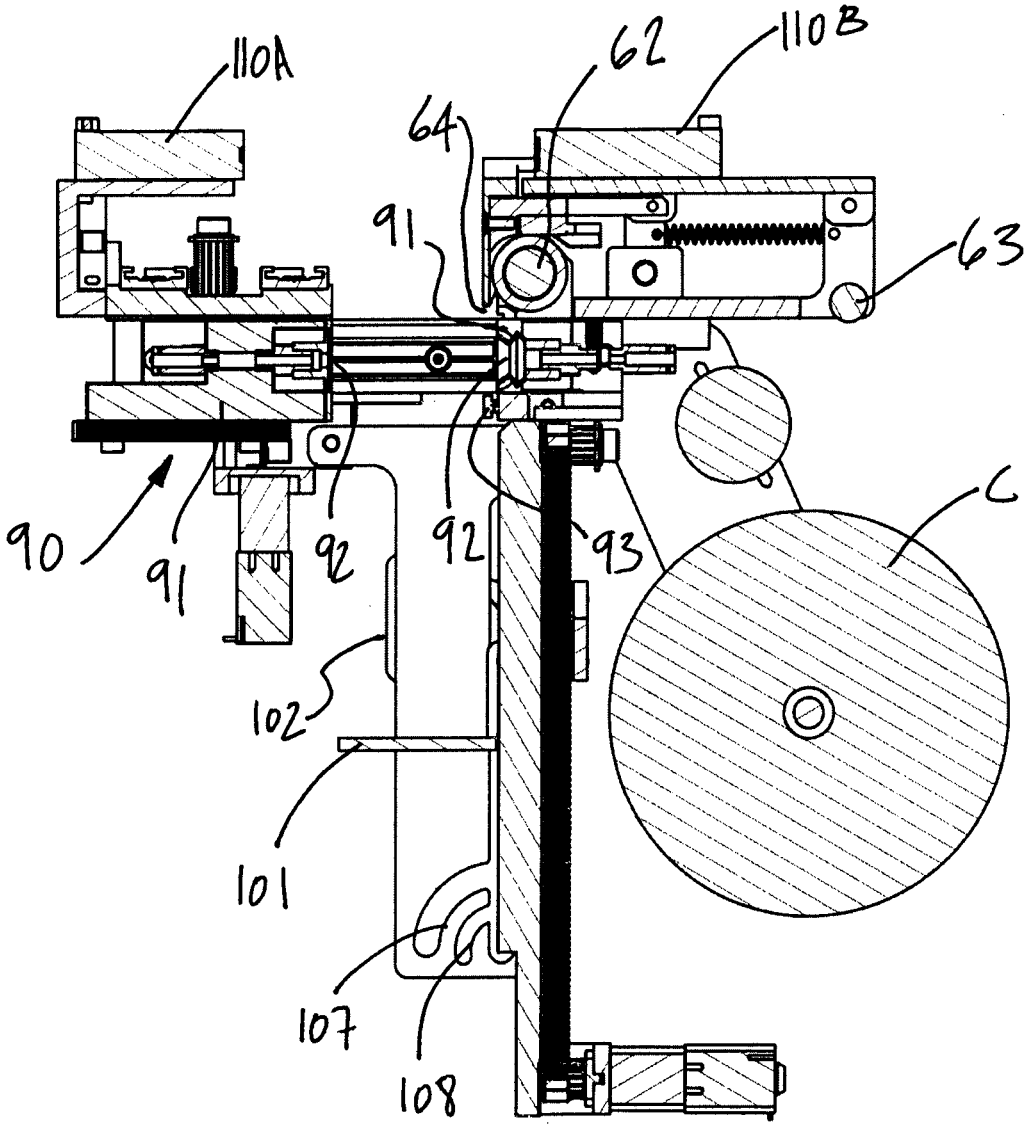
FIG. 7 is a sectional view of the bagging apparatus of FIG. 1.

Referring concurrently to FIGS. 1 and 7, the sealing apparatus 90 has a pair of jaws 91 facing each other and positioned below the cutting apparatus 80 and the feeding system 60 in the filling area of the bagging apparatus 50. The jaws 91 each have a suction cup 92 that is actuated to grasp the open-ended pouch in the filling area. The jaws 91 are translated toward one another so as to each capture a respective panel of the pouch in the filling area by suction of the suction cups 92. The jaws 91 are then translated away from one another so as to open the pouch, such that items may be dropped into the opened pouch.

Once the item/items have been dispensed into the pouch, the jaws 91 are brought back against one another to close the pouch with its contents. The sealing tool 93, moving with its jaw 91, is then used to seal the pouch shut with its contents. It is pointed out that the other jaw 91 features one anti-adhesive band opposite the sealing tool 93, to prevent melted plastic to adhere to the jaw 91. It is pointed out that the jaw 91 that does not feature the sealing tool 93 preferably translates against the other jaw 91, which other jaw 91 is fixed. However, other combinations are also considered. Moreover, the suction cups 92 present one of numerous alternatives to grasp the pouch. Other devices are considered such as grasping fingers, clips and the like.

Figure 3:
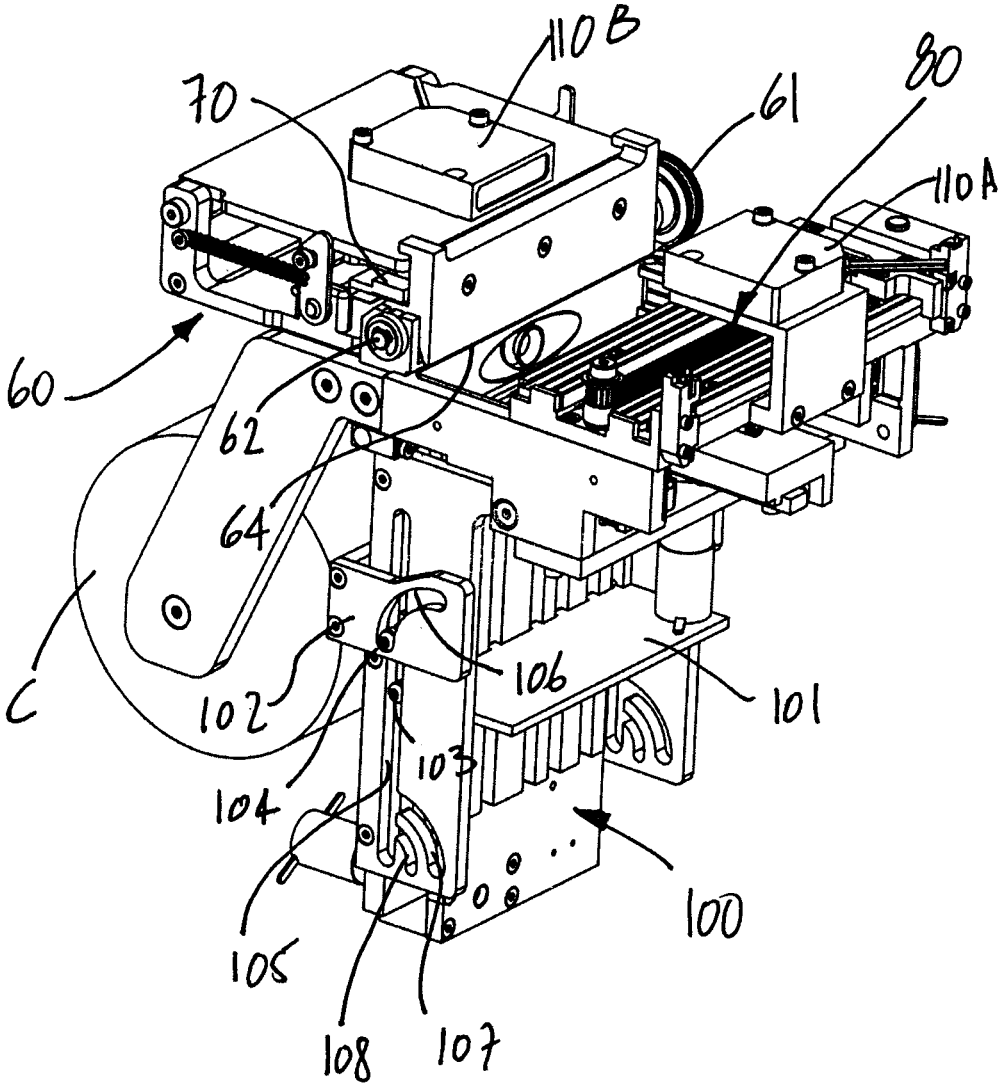
FIG. 3 is a rear left-side perspective view of the bagging apparatus of FIG. 1.
Figure 6:
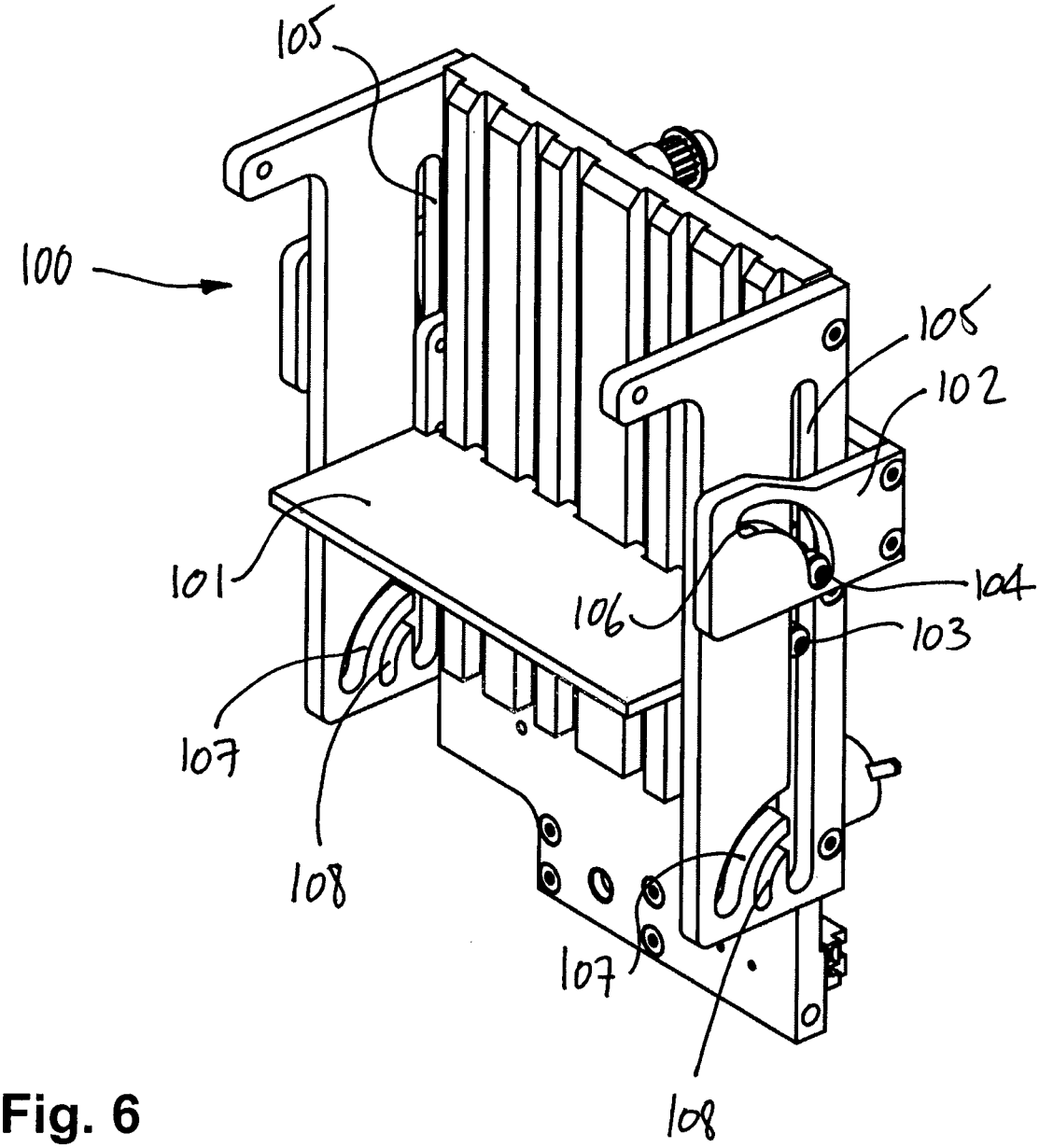
FIG. 6 is a perspective view of a chute support of the bagging apparatus of FIG. 1.

Referring concurrently to FIGS. 1, 3 and 6, the chute support 100 has a support plate 101. The support plate 101 translates vertically along direction Y. The support plate 101 delimits the bottom end of the filling area, and is positioned vertically as a function of the size of the item to be bagged. More specifically, in order to avoid an item damaging the pouch, the vertical position of the support plate 101 within the filling area is adjusted as a function of the size of the item being dispensed into the pouch.

The chute support 100 has a bracket 102 that is the interface between the actuation means (timing belt and gear assembly) and the support plate 101. Accordingly, the bracket 101 translates with the support plate 101. The support plate 101 has first pins 103 and second pins 104 at both ends. The first pins 103 are accommodated in guide slots 105 in the casing of the chute support 100, and move up and down along the guide slots 105.

The second pins 104 are connected to the bracket 101, by being accommodated in biasing slots 106. Accordingly, when the bracket 101 moves downwardly, the biasing slots 106 exert pressure on the second pins 104. When the second pins 104 are aligned with balancing slots 107 in the casing of the chute support 100, the pressure exerted by the biasing slots 106 forces the second pins 104 into the flipping slots 107, and the first pins 103 in the other set of flipping slots 108. This creates a pivoting motion of the support plate 101, to drop the filled pouch out of the chute support 100. Other configurations are considered to perform the vertical motion and pivoting motion of the support plate 101.

Referring to FIGS. 1 and 2, an optical detector system 110 optically verifies that the contents have been dispensed into the pouch. The system 100 has an emitter 110A and a receiver 110B, that detect any movement therebetween. The emitter 110A and receiver 110B are sized so as to cover the full width of the pouch. Other types of detection systems may be used, such as weight sensors on the support plate 101, and the like.

Figure 8:
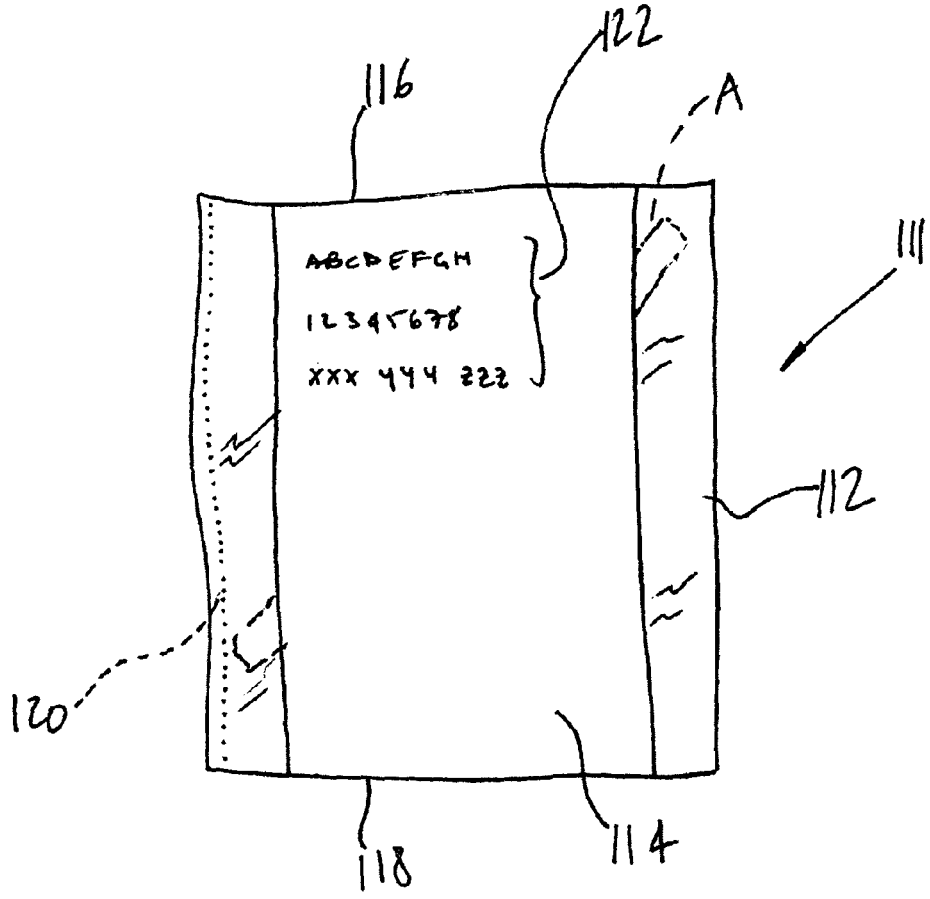
FIG. 8 is a schematic view of a distribution pouch produced by the bagging apparatus of FIG. 1, enclosing a syringe.

Referring to the drawings and more particularly to FIG. 8, a distribution pouch or bag in accordance with an embodiment of the present application is generally shown at 111, as produced by the bagging apparatus 50.

The distribution pouch 111 is made of a plastic tube 112 supporting a strip of paper 114. The tube 112 is a film folded or sealed on its lateral edges to form the tube. The tube 112 is sealed and cut at the top edge 116 and at the bottom edge 118 to form the pouch 111, during the dispensing of the tube 112 from a bagging apparatus, as will be described hereinafter.

A perforation joint 120 is provided parallel to one of the lateral edges of the distribution pouch 111. The perforation joint 120 is manually torn off to access the contents of the pouch 111, namely a syringe A in the embodiment of FIG. 8.

Data 122 pertaining to the contents of the pouch 111 is printed directly onto the strip of paper 114. The data 122 is preferably printed by the bagging apparatus, whereby the strip of paper 114 is selected so as to be compatible with the printing head of the bagging apparatus. In an example, the strip of paper 114 is thermal paper that adheres to the tube 112. Moreover, the strip of paper 114 and tube 112 are provided in a roll, as will be described hereinafter. It is also considered to produce minute electronics (chips) in the roll C (e.g., in the central tube of the roll C or along the tube 112, which electronics will be required for the tube to be dispensed by the bagging apparatus 50. Accordingly, by such control, the operator of the dispensing system 10 can ensure that only selected types of resins will be used, for instance to avoid contamination of the products that will be dispensed.

In an embodiment, the pouch 111 is used as part of a medical dispenser. Accordingly, drugs, medication or any like pharmaceutical product of suitable size are distributed in one of the pouches 111. In FIG. 8, the syringe A contains a dose of a pharmaceutical product that is destined for a patient. Therefore, the data 122 typically includes the patient's name, the product identification and dose, the time period at which the dose must be administered to the patient, and the identification of the physician or pharmacist having prescribed the dose. Once the dose has been administered, the pouch 111 may be used as a disposal bag, if the dose came from a dispensing instrument (e.g., a syringe).

Figure 9:
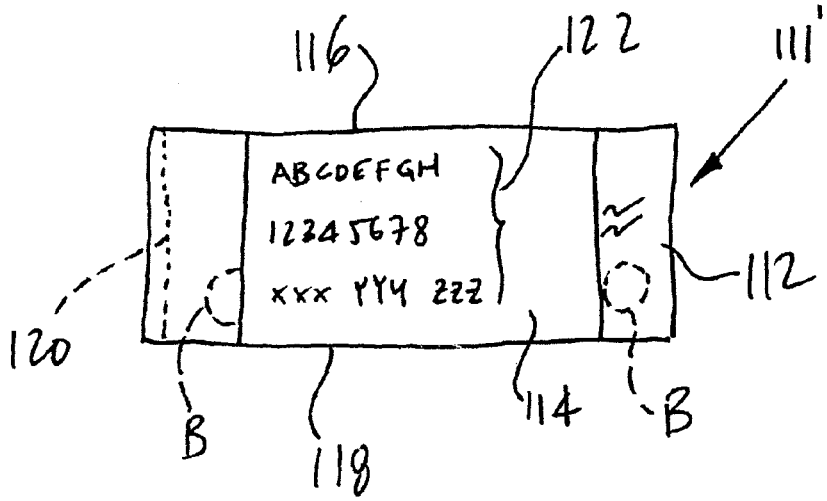
FIG. 9 is a schematic view of a distribution pouch produced by the bagging apparatus of FIG. 1, enclosing pills.

Referring to FIG. 9, a distribution pouch 111' is illustrated. The pouch 111' is similar to the pouch 111 of FIG. 8, as it is produced by the same bagging apparatus. However, the pouch 111' contains pills B, whereby the pouch 111' is smaller than the pouch 111.

The following sequence of events is performed to produce the pouches 111/111' with their contents. Once a request for a dose has been entered by appropriate personnel, a controller (e.g., a computer having a processor) displaces the support plate 101 of the chute support 100 to an appropriate height in view of the format of the dose, and activates the printer 70 to print the appropriate data 122 on the output end of tube 112/paper 114 being dispensed from the roll C. The output end is already sealed from a previous operation.

With the information printed on the strip of paper 114, a suitable length of tube 112/paper 114 is dispensed from the roll C, through the actuation of the feeding system 60 by the controller. Once a suitable length has reached the cutting apparatus 80, the tube 112/paper 114 is cut to define the size of the pouch 111. The free end of the roll C is sealed off for subsequent bagging operations, with the sealing apparatus 90.

The top edge 116 of the pouch 111 is maintained open by the sealing apparatus 90. The product is then dispensed through a chute into the open pouch 111, and is partially supported by the support plate 101. The optical detection system 110 ensures that the appropriate dose has been dispensed into the pouch 111/111'. If the appropriate dose is detected, the controller actuates the sealing apparatus 90 54 to seal the pouch 111/111'. The chute support 100 then lowers the product to a dispensing position.

Figure 13:
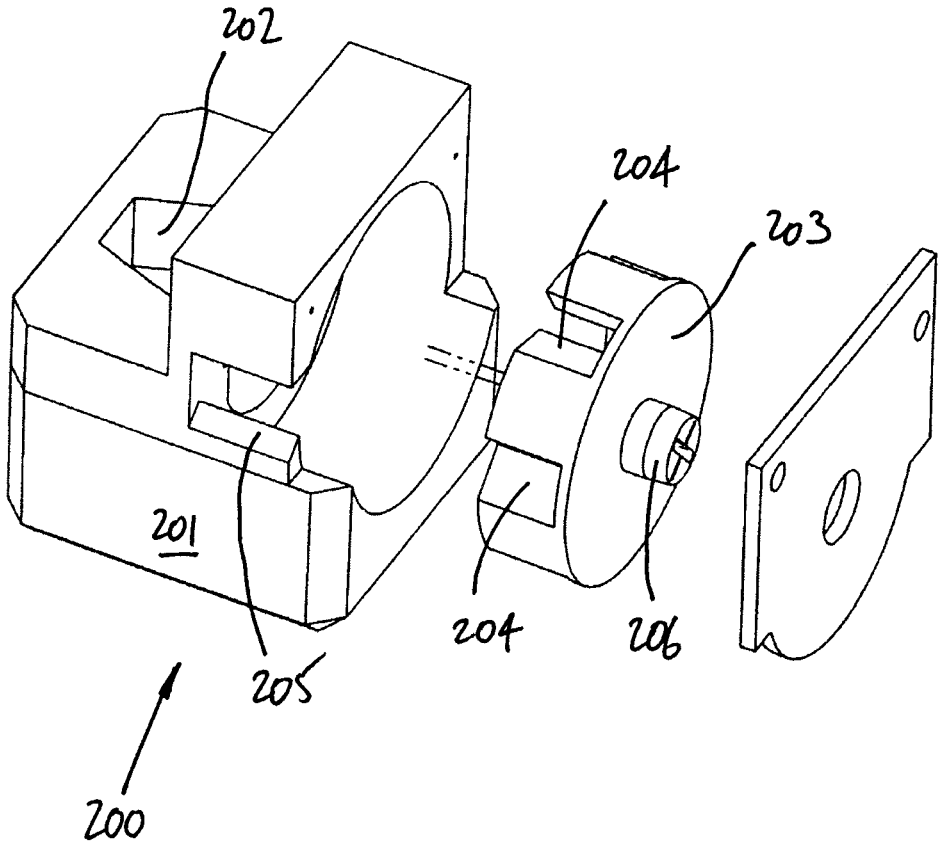
FIG. 13 is an exploded view of a bulk dispenser device in accordance with yet another embodiment of the present application.

Referring to FIG. 13, a bulk dispenser device is generally shown at 200. The bulk dispenser device 200 is typically placed in one of the cassettes 25, and is used to dispense bulk products, such as medication tablets.

The bulk dispenser device 200 has a base 201, upon which is mounted a recipient (not shown). A trough 202 is defined in the base 201, and is in communication with a bottom of the recipient, such that the bulk tablets of the recipient are guided toward the slotted wheel 203. The wheel 203 has a plurality of slots 204 that are oriented radially on the wheel 203. Each slot 204 is sized so as to receive one single tablet from the recipient. Accordingly, the size of the slots 204 is selected as a function of the tablets that will be dispensed by the bulk dispenser device 200.

An outlet 205 is provided in the side of the base 201 and is aligned with the slots 204. Therefore, upon rotation of the wheel, the slots 204 will align one by one with the outlet 205, so as to provide an exit for the tablets in the slots 204.

A shaft 206 is provided in the center of the wheel 203. The wheel 203 is actuated through the shaft 206, for instance, by way of a rack-and-pinion arrangement, as will be described hereinafter.

Figure 14:
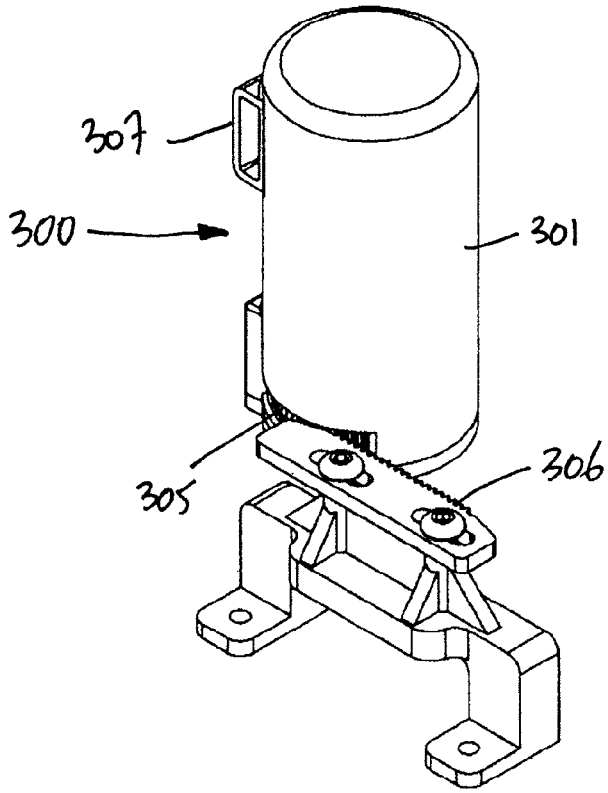
FIG. 14 is a perspective view of a bulk dispenser device in accordance with yet another embodiment of the present application.
Figure 15:
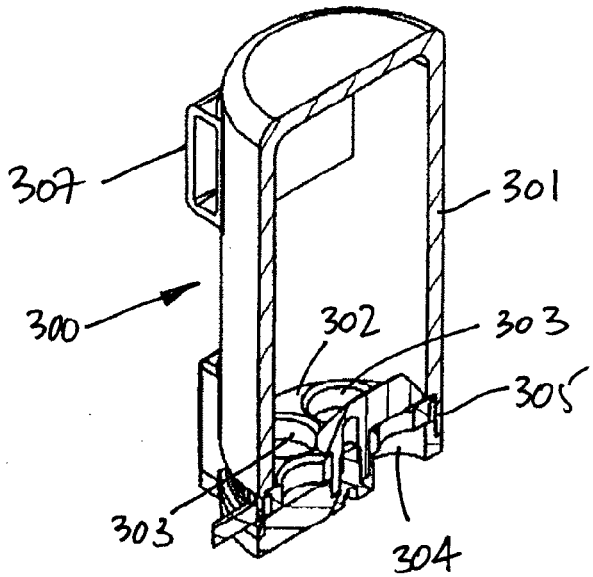
FIG. 15 is a sectional view of the bulk dispenser device of FIG. 14.

Referring concurrently to FIGS. 14 and 15, a bulk dispenser device in accordance with another embodiment of the present application is generally shown at 300. The bulk dispenser device 300 has a cylindrical body 301 that forms a recipient for receiving various tablets. A wheel 302 is positioned in a bottom of the cylindrical body 301 and has a plurality of openings 303, each sized so as to receive a tablet. Accordingly, the wheel 302 is selected as a function of the dimensions of the tablets that the bulk dispenser device 300 will accommodate.

An outlet 304 is provided at a bottom of the cylindrical body 301, and is aligned with the openings 303 in the wheel 302. Therefore, the rotation of the wheel 302 will have the openings 303 align with the outlet 304 one after the other.

In order to actuate the rotation of the wheel 302, a gear periphery 305 is provided on the wheel 302. Therefore, as illustrated in FIG. 14, a translation of the bulk dispenser device 300 along a rack 306 will cause a rotation of the wheel 302 by interaction between the rack 306 and the gear periphery 305. A hook 307 is provided on a periphery of the cylindrical body 301, so as to allow the manipulation of the bulk dispenser device 300 by the grasping tool 41.

In order to restock the dispensing system 10, an operator is required to prepare the various cassettes 25 and record the contents of the cassettes 25 in the controller unit of the dispensing system 10. It is also considered to enter contents data using remote computers, wireless transmission, etc. More specifically, information such as the position on the cassette 25 of the various items (e.g., medication, medical devices, bulk dispenser devices) is entered into the dispensing system 10, as well as the identification of the shelve 36 of the restocking volume 35 in which the cassette 25 is inserted.

Once the stocking of the restocking volume 35 is completed, the front panel 16 is closed. At this point, all manipulations are effected by the robotic arm 40. Therefore, all displacements between the storage volume 30, the restocking volume 35 and the bagging apparatus 50 are controlled, whereby the position of the products on the cassettes 25 is known. Therefore, if a medical device is dispensed by the bagging apparatus, 50, the inventory will note that the cassette 25 that supported the mechanical device has dispensed same, with a confirmation being provided by the optical detector system 110. All transactions are noted, and the inventory is updated in real-time.

In order to return a used medical device or unused medication, it is recommended that these items be returned in their original dispensing pouch. As the pouch typically features a bar code, a reading is taken with the bar-code reader 18, so as to record the dispending of the pouch. A detector in the front panel will confirm that the pouch has been thrown away through the access door 20. If the original pouch is not available, the system can output an empty pouch with information printed thereon, such as the original date or the patient or user identification.

The dispensing of products using the dispensing system 10 involves a tight control of authorizations when the dispensing system 10 is used in given industries. For instance, in the dispensing of medical products and medication, the dispensing of products must take into account numerous factors, such as prescriptions, acceptable doses, illegal use of narcotics, contra-indications. On the other hand, it is considered to provide some freedom of access in view of emergencies.

In one embodiment, the user of the dispensing system 10 must first identify himself/herself in order to perform transactions/place orders with the dispensing system 10. The various user interfaces of the dispensing system 10 described above are used for the identification. After authorization has been granted by the controller unit of the dispensing system 10, the user enters patient and prescription information. The controller unit may address messages to the user via the monitor 17. Otherwise, the controller unit drives the various components so as to prepare the prescription and dispense the prescribed products through the outlet of the dispensing system 10.

In another embodiment, the controller unit may allow temporary orders of medication if authorized personnel can provide enough information to identify a patient (e.g., manual entries), or if the controller unit has not yet been provided with a patient profile or a prescription. In such cases, the authorized personnel would be identified as operator for the dispensing of a product with partial authorization, and the entered information would be printed on the pouch or tube, as well as any other indication provided by prescribing personnel (e.g., physician). It is however important to provide relevant information pertaining to the product, such as contra-indications. The controller unit takes into account such transactions in a patient profile, or for subsequent reconciliation with a main server when prescription data is uploaded to the controller unit. Any improper dispensing identified during reconciliation will be signaled.

Moreover, a patient profile may exist in the controller unit while a prescription has not yet been uploaded to the controller unit. In such a case, authorized personnel may be able to temporarily prescribe medication, but has access to the patient profile to identify allergies and other potential problems for the patient.

The controller unit may alarm maintenance personnel of low levels of inventory for specific products. Moreover, a plurality of dispensing systems 10 may be interconnected via network to share information. If one of the dispensing systems 10 runs out of an item, the user may be informed of other dispensing systems 10 of the network having the item in stock.

In addition to medical uses, the dispensing system 10 may be used to distribute parts or tools. For instance, in the metal-working industry (machining, milling, welding, etc), tools such as drill bits, nuts and bolts, etc, may be dispensed using the dispensing system 10.

In another embodiment, the controller unit is to connected to a bar-code reader or other type of reader (e.g., RFID reader) within the casing 15, and each of the cassettes/trays 25 has corresponding data, such as a bar code or an RFID tag. Moreover, given items and the bulk dispensing devices 200 and 300 may also be provided with the corresponding data. When the trays 25 are inserted in the restocking volume 35, a reading may be taken to initiate the position of the tray 25 and its contents in the casing 15. Moreover, any displacement of trays 25/products or dispensing of products within the casing 15 may be accompanied by a reading of the bar codes to confirm the displacement, and that the correct item(s) is being manipulated accordingly to the given transaction or routine to be accomplished.

The invention claimed is:

1. A system for dispensing items comprising:

trays each adapted to support at least one item to be dispensed, the trays being displaceable within a volume when used, the trays each having at least a pair of connector units on opposite edges;

a casing comprising a restocking volume receiving trays with items thereon for subsequent storage, a storage volume for accommodating the trays in storage, an outlet for dispensing any selected one of the items on the trays, and an arm to displace trays at least between the restocking volume and the storage volume, and for displacing items from the trays to the outlet, the arm having a grasping tool displaceable in at least three translational degrees of freedom for grasping a single one of the pair of connectors of the trays during manipulation of each said tray within the volume, the restocking volume and the storage volume each have shelves facing each other in the casing, and a transition table in the casing to allow the arm to lay down a bottom of one of said tray on top of the transition table for the grasping tool to switch from one said connector to another said connector on a displaced tray to move said displaced tray between the shelves of the restocking volume to the shelves of the storage volume;

at least one user interface; and a controller unit for receiving an identification of each item in the trays when positioned in the restocking volume, and for monitoring a position of each identified item within the trays in the casing to control the actuation of the arm to manipulate the trays within the casing and to dispense items through the outlet as a function of an order entered through the user interface.

2. The system according to claim 1, wherein the restocking volume and the storage volume each have shelves facing each other in the casing, with the restocking volume being accessed through an front panel of the casing for an operator to restock the casing.

3. The system according to claim 1, further comprising a front panel pivotable to provide access to an interior of the casing, with at least one of the user interface being on the front panel.

4. The system according to claim 1, further comprising a bagging apparatus at the outlet in the casing, so as to bag items being dispensed through the outlet.

5. The system according to claim 4, wherein the bagging apparatus has a printer for printing on bags information related to the order of the item being dispensed.

6. The system according to claim 4, wherein the bagging apparatus further comprises sealing and cutting apparatuses, to enclose dispensed items in closed pouches.

7. The system according to claim 4, wherein the bagging apparatus comprises a support at the outlet, the support being displaceable vertically in order to support an item being bagged prior to the disposal.

8. The system according to claim 1, further comprising a selectively lockable door at the outlet so as to control access to the outlet.

9. The system according to claim 1, further comprising optical sensors to confirm to the controller unit the dispensing of items for the controller unit to adjust inventory data.

10. The system according to claim 1, further comprising a disposal bin, the disposal bin having a drop opening selectively opened through the controller unit to return items in the system.

11. The system according to claim 1, further comprising a bulk dispenser in any one of the trays, the bulk dispenser being actuatable to output at least one item from a bulk container of items.

12. The system according to claim 1, further comprising a reader in the casing and readable data on the trays, for the controller unit to confirm an identity of each tray displaced in the casing.

* * * * *